US008695280B2

(12) United States Patent
Park

(10) Patent No.: US 8,695,280 B2
(45) Date of Patent: Apr. 15, 2014

(54) WATER-FILLED FIREPROOF DOOR AND FIREPROOF DOOR FRAME

(76) Inventor: Gap Hwan Park, Gimhae-si (KR)

( * ) Notice: Subject to any disclaimer, the term of this patent is extended or adjusted under 35 U.S.C. 154(b) by 0 days.

(21) Appl. No.: 13/515,150

(22) PCT Filed: Dec. 14, 2010

(86) PCT No.: PCT/KR2010/008913

§ 371 (c)(1),
(2), (4) Date: Jun. 11, 2012

(87) PCT Pub. No.: WO2011/074845

PCT Pub. Date: Jun. 23, 2011

(65) Prior Publication Data

US 2012/0285102 A1 Nov. 15, 2012

(30) Foreign Application Priority Data

Dec. 15, 2009 (KR) ..... 10-2009-0214741

(51) Int. Cl.
*E04H 9/00* (2006.01)

(52) U.S. Cl.
USPC ..... 52/1; 52/168

(58) Field of Classification Search
USPC ..... 52/1, 168, 232, 784.11; 238/208; 49/504, 386, 920
See application file for complete search history.

(56) References Cited

U.S. PATENT DOCUMENTS

| | | | | |
|---|---|---|---|---|
| 3,935,681 | A * | 2/1976 | Voiturier et al. | 52/1 |
| 4,301,631 | A * | 11/1981 | Tazaki | 52/168 |
| 6,643,991 | B1 * | 11/2003 | Moyes | 52/784.11 |
| 6,918,447 | B2 * | 7/2005 | Robinson, Jr. | 169/45 |

FOREIGN PATENT DOCUMENTS

| | | | |
|---|---|---|---|
| EP | 0745751 | A2 | 12/1996 |
| JP | 2000-073469 | A | 3/2000 |
| JP | 2005-194852 | A | 7/2005 |
| KR | 10-2005-0119840 | A | 12/2005 |

* cited by examiner

*Primary Examiner* — Jeanette E Chapman
*Assistant Examiner* — Daniel Kenny
(74) *Attorney, Agent, or Firm* — Sherr & Jiang, PLLC

(57) ABSTRACT

Provided are a fireproof door and a fireproof door frame. The fireproof door includes a water receiving part, a groove, a water expansion substance, an intake port, and a plurality of supply holes. The water receiving part holds water therein. The groove is formed along an edge of the fireproof door. The water expansion substance is inserted into the groove along the edge and expands when absorbing water to seal a gap between a door frame and the fireproof door. The intake port is disposed at a lower portion to supply water into the water receiving part. The plurality of supply holes is disposed along the groove between the water receiving part and the water expansion substance to supply water held in the water receiving part through the intake port to the water expansion substance.

8 Claims, 9 Drawing Sheets

*-Prior Art-*

WATER-FILLED FIREPROOF DOOR AND FIREPROOF DOOR FRAME

CROSS REFERENCE TO PRIOR APPLICATIONS

This application is a National Stage Patent Application of PCT International Patent Application No. PCT/KR2010/008913 (filed on Dec. 14, 2010) under 35 U.S.C. §371, which claims priority to Korean Patent Application No. 10-2009-0124741 (filed on Dec. 15, 2009), which are all hereby incorporated by reference in their entirety.

TECHNICAL FIELD

The following disclosure relates to a fireproof door and a fireproof door frame, and in particularly, to a fireproof door and a fireproof door frame, which can interrupt heat by allowing water to flow therein and can prevent toxic gases from flowing into the interior by sealing a gap between the door and the door frame.

BACKGROUND ART

Korean Utility Model Publication No. 20-2009-0003213 discloses a typical fireproof door and fireproof door frame. FIG. 10 is a view illustrating the fireproof door and the fireproof door frame that are disclosed in the above cited reference. In case of fire, water is supplied to an upper water supply nipple 2 to fill a door frame 3 with water. When the door frame 3 is full of water, water flows into the inside of a door 4 through a door frame water hole 6. Water filled in the door frame 3 and the door 4 prevents fire from spreading.

A typical fireproof door and fireproof door frame disclosed in Korean Utility Model Publication No. 20-2009-0003213 interrupts flames and heat by filling water therein and supplying water. However, fire casualties are caused by toxic gases rather than direct flames. Accordingly, interrupting toxic gases is as important as blocking flames and heat. The typical fireproof door and fireproof door frame have a limitation in that toxic gases generated by fire cannot be interrupted.

Also, although the typical fireproof door is filled with water in case of fire, water does not circulate inside the fireproof door but stand still. In this case, when the intensity of flame is relatively strong, flames and heat cannot be sufficiently interrupted.

DISCLOSURE

Technical Problem

Accordingly, the present disclosure provides a fireproof door and a fireproof door frame, which can interrupt toxic gases generated at fire from flowing into the interior by completely sealing a gap between the door and the door frame.

The present disclosure also provides a fireproof door frame which can performing a fire-extinguishing function as well as interrupting heat, by filling water in the door frame and then directly spraying water to the outside.

Technical Solution

In one general aspect, a fireproof door includes: a water receiving part for holding water therein; a groove formed along an edge of the fireproof door; a water expansion substance inserted into the groove along the edge and expanding when absorbing water to seal a gap between a door frame and the fireproof door; an intake port disposed at a lower portion to supply water into the water receiving part; and a plurality of supply holes disposed along the groove between the water receiving part and the water expansion substance to supply water held in the water receiving part through the intake port to the water expansion substance.

The fireproof door may further include a plurality of partitions coupled to both sides of the water receiving part such that a water passage is formed in a zigzag pattern in the water receiving part from a lower part to an upper part of the fireproof door.

The fireproof door may further include a plurality of discharge ports at the upper part of the fireproof door to discharge water out of the water receiving part.

The fireproof door may further include a water supply unit for sensing fire and then supplying water to the water receiving part through the intake port.

In another general aspect, a fireproof door frame includes: a water receiving part for holding water therein; a groove formed along an edge of the fireproof door; a water expansion substance inserted into the groove along the edge and expanding when absorbing water to seal a gap between the fireproof door frame and a door; an intake port disposed at a lower portion to supply water into the water receiving part; and a plurality of supply holes disposed along the groove between the water receiving part and the water expansion substance to supply water held in the water receiving part through the intake port to the water expansion substance.

The groove may be formed along an edge of the fireproof door frame contacting the door.

The fireproof door frame may further include a plurality of discharge ports at the upper part of the fireproof door to discharge water out of the water receiving part.

The fireproof door frame may further include a water supply unit for sensing fire and then supplying water to the water receiving part through the intake port.

Other features and aspects will be apparent from the following detailed description, the drawings, and the claims.

BEST MODE

Figure 1:
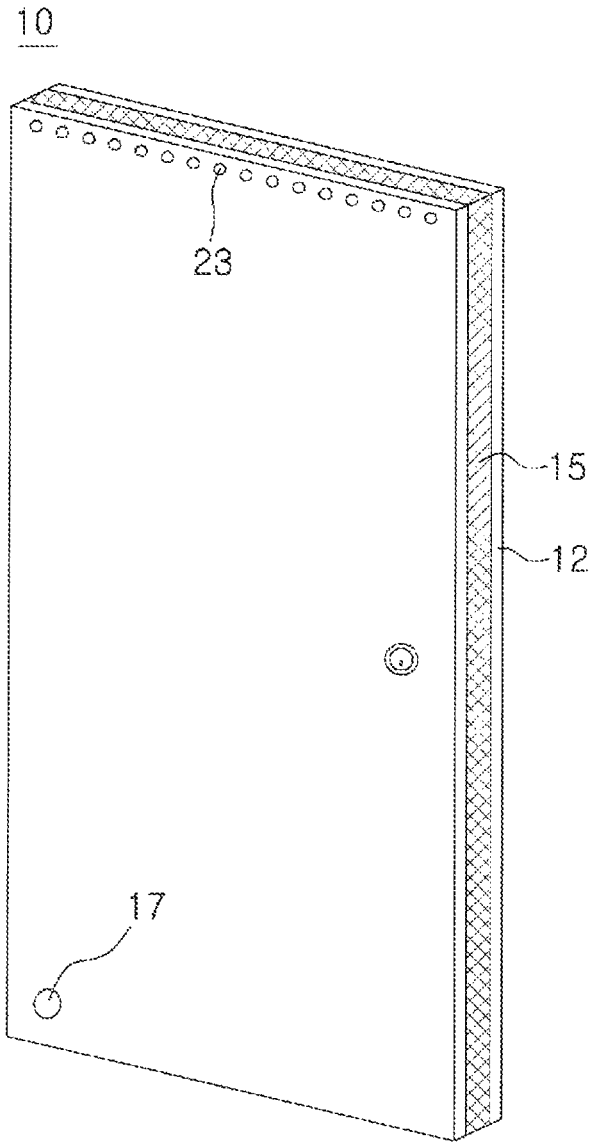
FIG. 1 is a perspective view of a fireproof door according to an embodiment of the present invention.

Hereinafter, exemplary embodiments will be described in detail with reference to the accompanying drawings. Throughout the drawings and the detailed description, unless otherwise described, the same drawing reference numerals will be understood to refer to the same elements, features, and structures. The relative size and depiction of these elements may be exaggerated for clarity, illustration, and convenience. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

A fireproof door and a fireproof door frame according to an embodiment of the present invention may be together or separately used. According to embodiments, the fireproof door and the fireproof door frame can be used together, and the fireproof door may be used together with a typical door frame or the fireproof door frame may be used together with a typical fireproof door. Accordingly, the fireproof door and the fireproof door frame will be separately described below.

Figure 2:
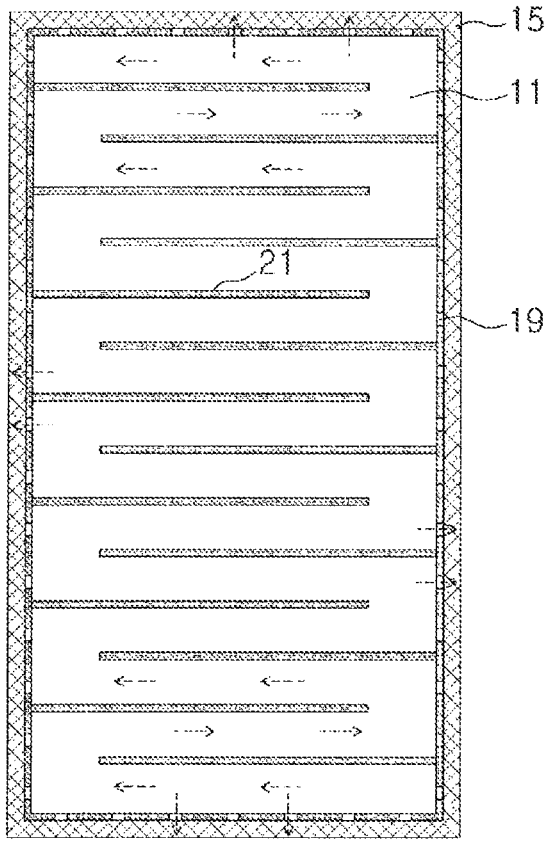
FIG. 2 is a front cross-sectional view of the fireproof door of FIG. 1.
Figure 3:
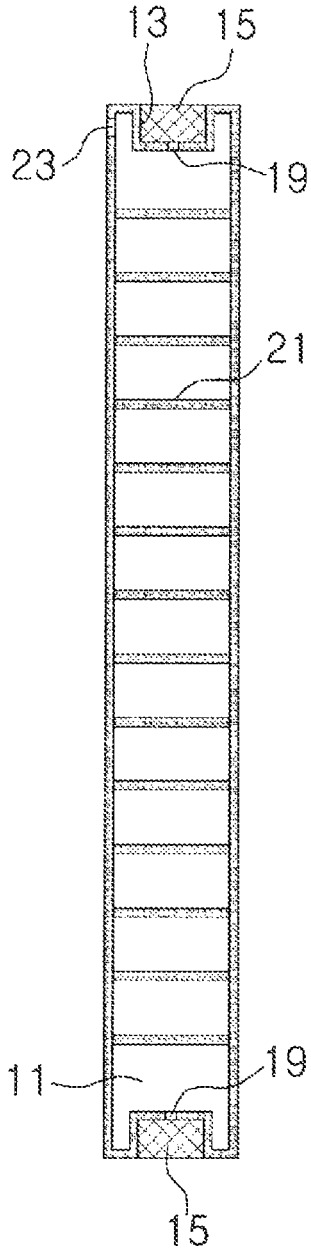
FIG. 3 is a side cross-sectional view of the fireproof door of FIG. 1.
Figure 4:
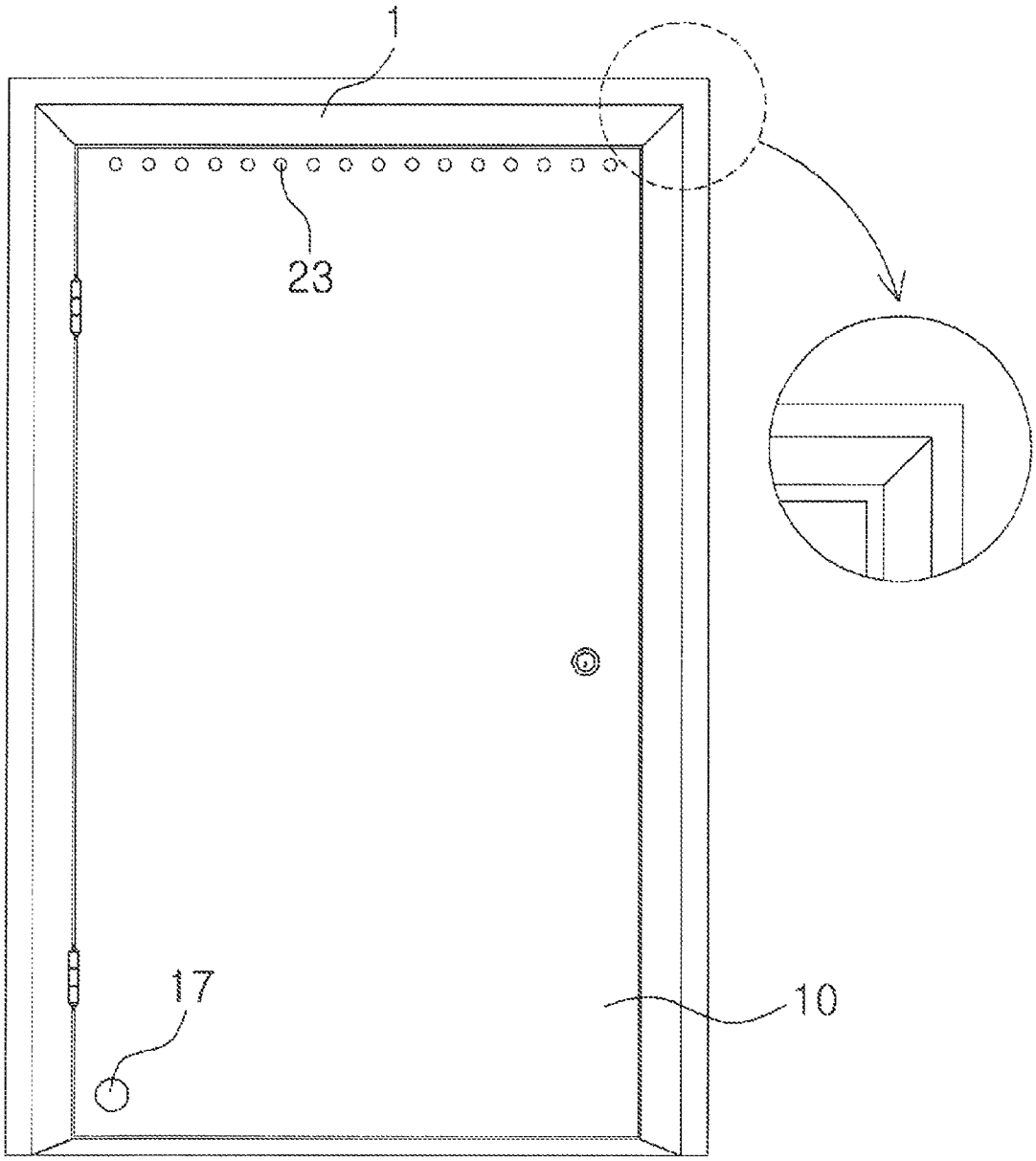
FIG. 4 is a view illustrating a first operation of the fireproof door of FIG. 1.
Figure 5:
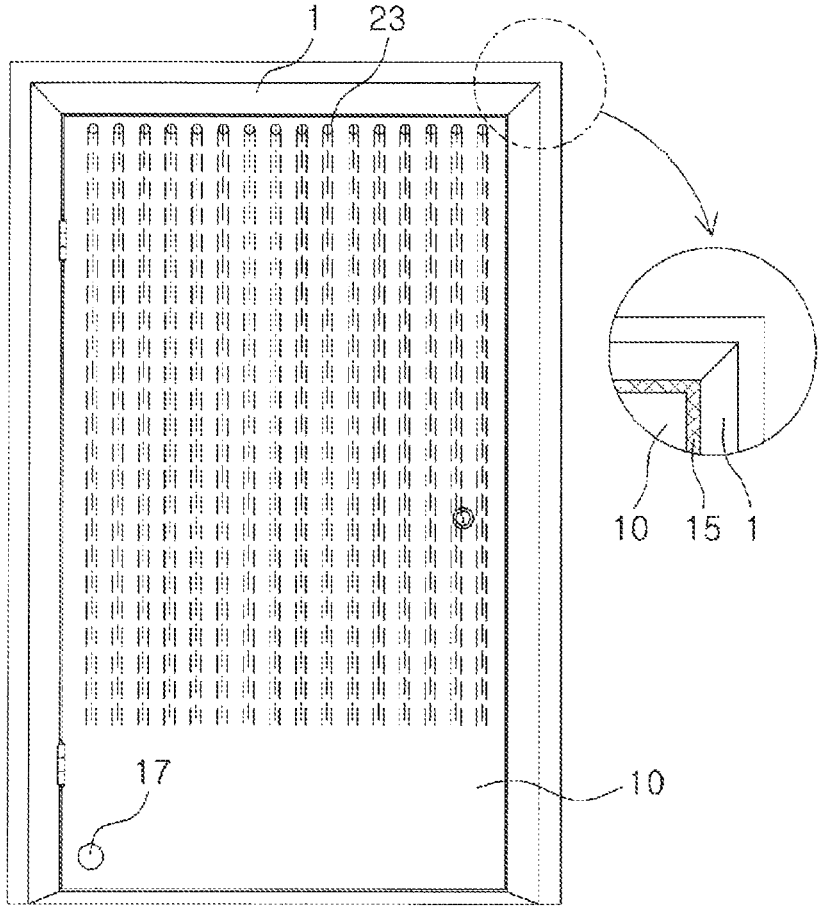
FIG. 5 is a view illustrating a second operation of the fireproof door of FIG. 1.

Hereinafter, an exemplary embodiment of a fireproof door will be described in detail with reference to the accompanying drawings. FIG. 1 is a perspective view of a fireproof door according to an embodiment of the present invention. FIG. 2 is a front cross-sectional view of the fireproof door of FIG. 1. FIG. 3 is a side cross-sectional view of the fireproof door of FIG. 1. FIG. 4 is a view illustrating a first operation of the fireproof door of FIG. 1. FIG. 5 is a view illustrating a second operation of the fireproof door of FIG. 1.

A fireproof door according to an embodiment of the present invention may include a water receiving part 11, a groove 13, a water expansion substance 15, a intake port 17, a plurality of supply holes 19, a plurality of partitions 21, a plurality of discharge ports 23, and a water supply unit (not shown).

The water receiving part 11 may be configured to hold water inside the fireproof door 10. The water receiving part 11 may be formed inside the fireproof door 10 to hold water therein.

The groove 13 may be disposed along the edge 12 of the fireproof door 10.

The water expansion substance 15 may be inserted into the groove 13 along the edge 12 such that when absorbing water, the water expansion substance 15 can expand to seal a gap between the door frame 1 and the fireproof door 10. The water expansion substance 15 may be formed of water expansion rubber or water expansion silicon.

The intake port 17 may be disposed at a lower portion of the fireproof door 10 to supply water to the water receiving part 11. Water supplied from a water supply may flow into the water receiving part 11 of the fireproof door 10 through the intake port 17.

The plurality of supply holes 19 may be formed along the groove 13 between water receiving part 11 and the water expansion substance 15 such that water held in the water receiving part 11 through the intake port 17 can be supplied to the water expansion substance 15.

The plurality of partitions 21 may form a water passage in the water receiving part 11. The plurality of partitions 21 may be coupled to both sides of the water receiving part 11, respectively to form a zigzag pattern. Water received from the intake port 17 may continuously flow along the water passage from the lower portion to the upper portion of the water receiving part 11.

The plurality of discharge ports 23 may be formed at the upper portion of the fireproof door 10 such that water held in the water receiving part 11 can be discharged out of the water receiving part 11.

The water supply unit (not shown) may sense fire, and then supply water to the water receiving part 11 through the intake port 17.

In an ordinary case where fire does not occur, the water receiving part 11 of the fireproof door 10 may not hold water. Accordingly, the water expansion substance 15 does not expand. In this case, as shown in FIG. 4, a gap may exist between the fireproof door 10 and the door frame 1, allowing air to flow through the gap.

However, when fire occurs, the water supply unit may sense fire and then supply water into the water receiving part 11 through the intake port 17.

Water flowing in through the intake port 17 may flow from the lower part to the upper part of the fireproof door 10 through the water passage formed by the partitions 21. In this case, water may be partially absorbed into the water expansion substance 15 through the plurality of supply holes 19 while flowing. Then, the water expansion substance 15 may expand to seal the gap between the fireproof door 10 and the door frame 1. When the gap is sealed by the water expansion substance 15, toxic gases generated by fire may be prevented from flowing into the interior. Also, since water continuously circulates in the fireproof door 10, flames and heat may be blocked from being delivered to the interior. When water continuously introduced reaches the top of the water receiving part 11, water may be discharged out of the fireproof door 10 through the plurality of discharge ports 23 as shown in FIG. 5. Water discharged to the outside may be used to reduce heat or extinguish frames generated by fire.

Accordingly, flames and heat can be extinguished or reduced by continuously circulating water in the fireproof door 10, and toxic gases can be prevented from flowing into the interior by sealing the gap between the fireproof door 10 and the door frame 1.

Figure 6:
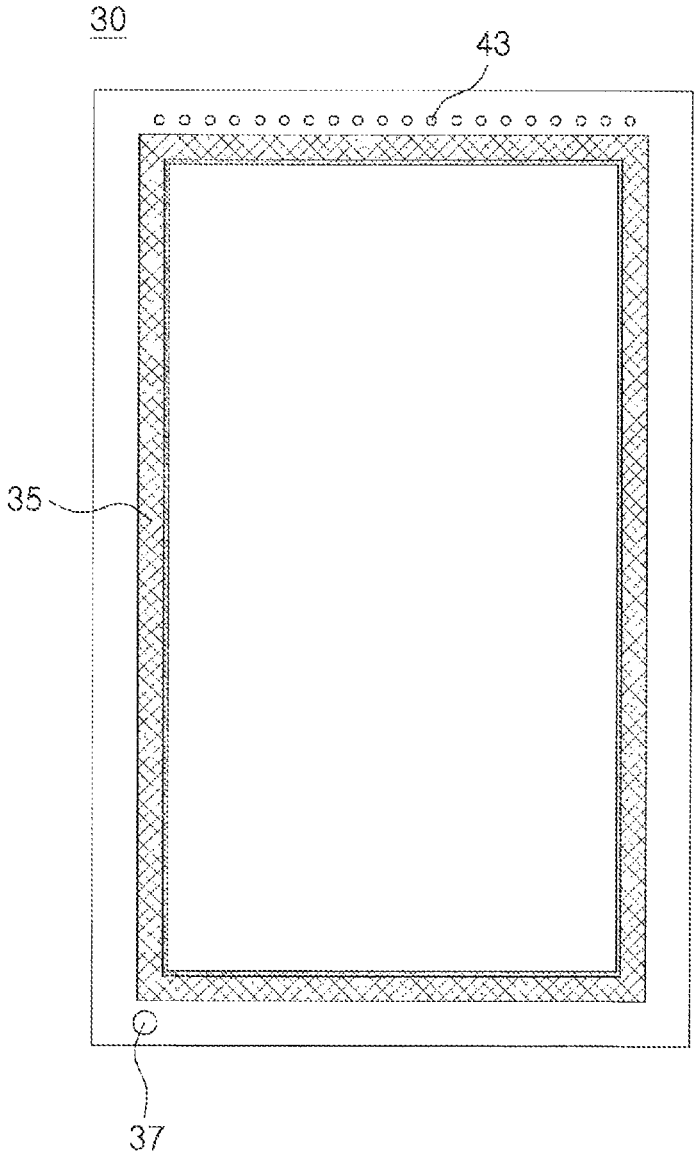
FIG. 6 is a front view of a fireproof door frame according to an embodiment of the present invention.
Figure 7:
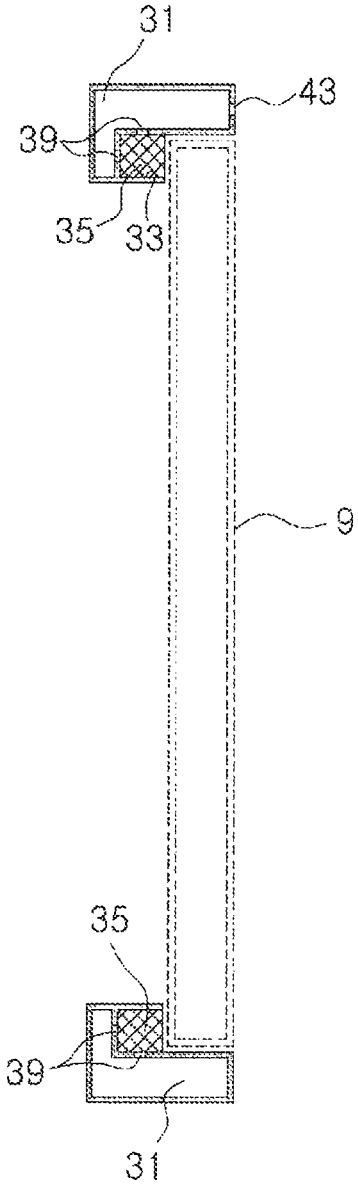
FIG. 7 is a side cross-sectional view of the fireproof door frame of FIG. 6.
Figure 8:
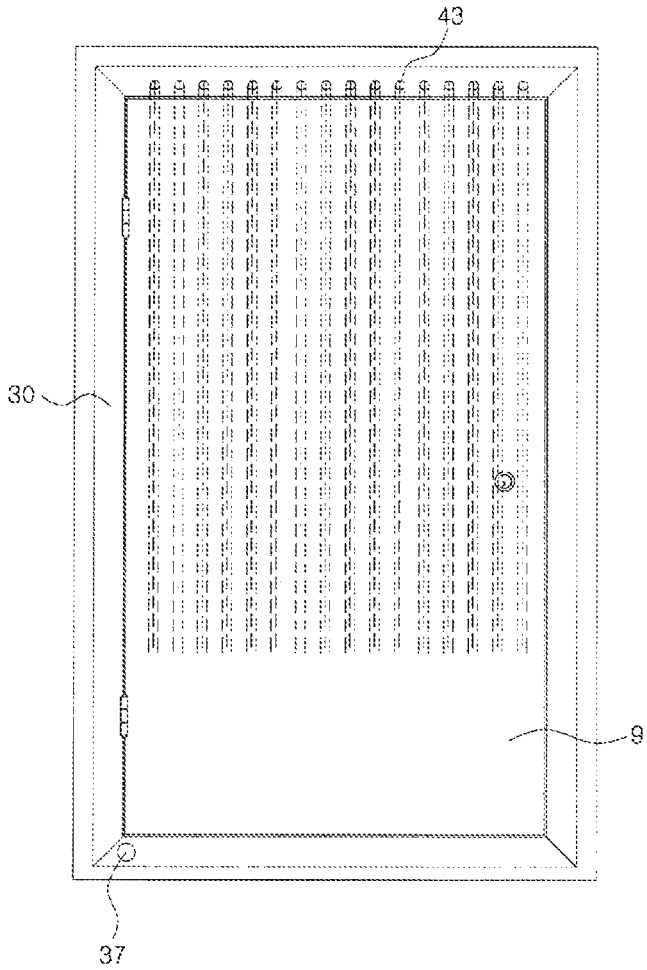
FIG. 8 is a view illustrating an exemplary operation of the fireproof door frame of FIG. 6.
Figure 9:
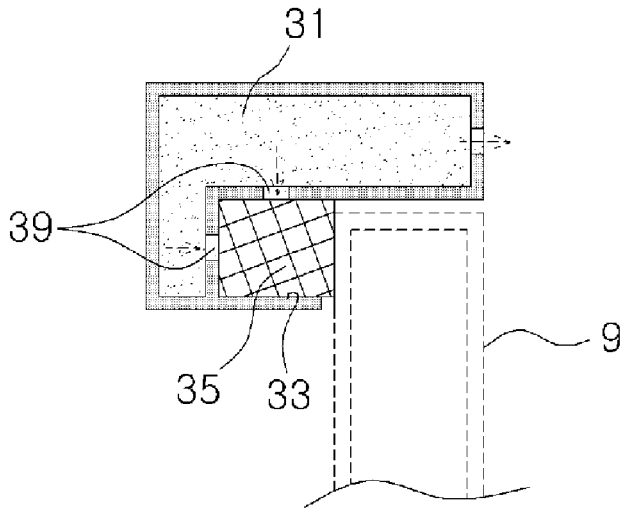
FIG. 9 is a side cross-sectional view illustrating an exemplary operation of the fireproof door frame of FIG. 8.
Figure 10:
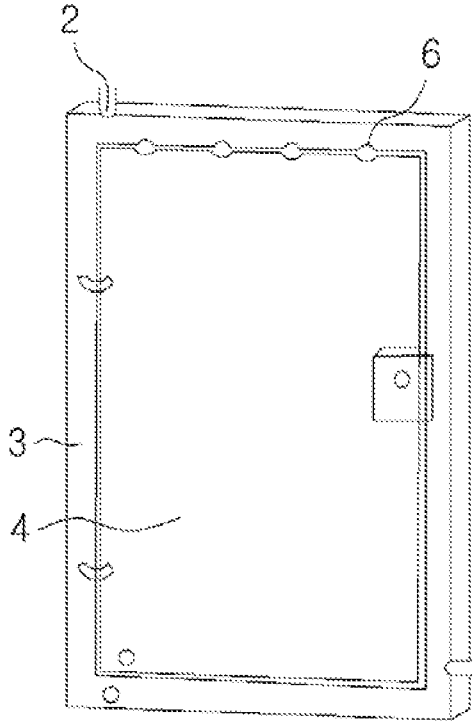
FIG. 10 is a view illustrating a typical fireproof door and a fireproof door frame.

Hereinafter, an exemplary embodiment of a fireproof door frame will be described in detail with reference to the accompany drawings. FIG. 6 is a front view of a fireproof door frame according to an embodiment of the present invention. FIG. 7 is a side cross-sectional view of the fireproof door frame of FIG. 6. FIG. 8 is a view illustrating an exemplary operation of the fireproof door frame of FIG. 6. FIG. 9 is a side cross-sectional view illustrating an exemplary operation of the fireproof door frame of FIG. 8.

A fireproof door frame 30 according to an embodiment of the present invention may include a water receiving part 31, a groove 33, a water expansion substance 35, an intake port 37, a plurality of supply holes 39, a plurality of discharge ports 43, and a water supply unit (not shown).

The water receiving part 31 may be configured to hold water inside the fireproof door frame 30. The water receiving part 31 may be formed inside the fireproof door frame 30 to hold water therein.

The groove 33 may be disposed along the inner edge 32 of the fireproof door frame 30. In this case, the groove 33 may be formed in the inner edge 32 that contacts a door 9 when the door 9 is closed.

The water expansion substance 35 may be inserted into the groove 33 along the inner edge 32 such that when absorbing water, the water expansion substance 35 can expand to seal a gap between the door 9 and the fireproof door frame 30. When absorbing water, the water expansion substance 35 may expand, and may be formed of water expansion rubber or water expansion silicon.

The intake port 37 may be disposed at a lower portion of the fireproof door frame 30 to supply water to the water receiving part 31. Water supplied from a water supply may flow into the water receiving part 31 of the fireproof door from 30 through the intake port 37. Since the intake port 37 is located at the lower portion of the fireproof door frame 30, the level of water introduced into the water receiving part 31 may keep rising.

The plurality of supply holes 39 may be formed along the groove 33 between water receiving part 31 and the water expansion substance 35 such that water held in the water receiving part 31 through the intake port 37 can be supplied to the water expansion substance 35. Water held in the water receiving part 31 may be absorbed by the water expansion substance 35 through the plurality of supply holes 39. Then, the water expansion substance 35 may expand to seal the gap between the fireproof door frame 39 and the door 9.

The plurality of discharge ports 43 may be formed at the upper portion of the fireproof door frame 30 such that water held in the water receiving part 31 can be discharged out of the water receiving part 31. When the water receiving part 31 is full of water, water may flow out to wet the door and thus extinguish flames.

The water supply unit (not shown) may sense fire, and then supply water to the water receiving part 31 through the intake port 37.

In an ordinary case where fire does not occur, the water receiving part 31 of the fireproof door 30 may not hold water. Accordingly, the water expansion substance 35 does not expand. In this case, as shown in FIG. 7, a gap may exist between the fireproof door frame 30 and the door 9, allowing air to flow through the gap.

However, when fire occurs, the water supply unit may sense fire and then supply water into the water receiving part 31 through the intake port 37.

Water flowing in through the intake port 37 may be stored in the fireproof door frame 30. In this case, water may be partially absorbed into the water expansion substance 35 through the plurality of supply holes 39. Then, the water expansion substance 35 may expand to seal the gap between the fireproof door frame 30 and the door 9. When the gap is sealed by the water expansion substance 35, toxic gases generated by fire may be prevented from flowing into the interior. Also, as shown in FIG. 8, since water is discharged to the outside through the plurality of discharge ports 43, flames and heat can be blocked from being delivered to the interior, and flames can also be extinguished.

Accordingly, flames and heat can be extinguished or reduced, and toxic gases can be prevented from flowing into the interior by sealing the gap between the fireproof door frame 30 and the door 9.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

INDUSTRIAL APPLICABILITY

According to embodiments, a fireproof door and a fireproof door frame including a water expansion substance inserted along the edges of the fireproof door and the fireproof door frame are provided to seal a gap between the door and the door frame by expanding the water expansion substance upon occurrence of fire. Accordingly, toxic gases can be prevented from flowing into the interior through the gap.

According to embodiments, a fireproof door including a water passage defined by partitions from the lower part to the upper part of the fireproof door is provided to allow water to flow from the lower part to the upper part of the fireproof door upon occurrence of fire. Thus, flames and heat can be effectively blocked.

According to embodiments, a fireproof door including a discharge port at the upper part thereof is provided to allow water to flow out through the discharge port upon occurrence of fire. Water discharged to the outside can block flames and heat and serve to extinguish flames.

The invention claimed is:

1. A fireproof door comprising:

a water receiving part for holding water therein;

a groove formed along an edge of the fireproof door;

a water expansion substance inserted into the groove along the edge and expanding when absorbing water to seal a gap between a door frame and the fireproof door;

an intake port disposed at a lower portion to supply water into the water receiving part; and a plurality of supply holes disposed along the groove between the water receiving part and the water expansion substance to supply water held in the water receiving part through the intake port to the water expansion substance.

2. The fireproof door of claim 1, further comprising a plurality of partitions coupled to both sides of the water receiving part such that a water passage is formed in a zigzag pattern in the water receiving part from a lower part to an upper part of the fireproof door.

3. The fireproof door of claim 2, further comprising a plurality of discharge ports at the upper part of the fireproof door to discharge water out of the water receiving part.

4. The fireproof door of claim 3, further comprising a water supply unit for sensing fire and then supplying water to the water receiving part through the intake port.

5. A fireproof door frame comprising:

a water receiving part for holding water therein;

a groove formed along an edge of a fireproof door;

a water expansion substance inserted into the groove along the edge and expanding when absorbing water to seal a gap between the fireproof door frame and a door;

an intake port disposed at a lower portion to supply water into the water receiving part; and a plurality of supply holes disposed along the groove between the water receiving part and the water expansion substance to supply water held in the water receiving part through the intake port to the water expansion substance.

6. The fireproof door frame of claim 5, wherein the groove is formed along an edge of the fireproof door frame contacting the door.

7. The fireproof door frame of claim 6, further comprising a plurality of discharge ports at the upper part of the fireproof door to discharge water out of the water receiving part.

8. The fireproof door frame of claim 7, further comprising a water supply unit for sensing fire and then supplying water to the water receiving part through the intake port.

* * * * *